United States Patent [19]

Kubitschek et al.

[11] 4,086,177

[45] Apr. 25, 1978

[54] ACTIVATED BLEACHING PROCESS AND COMPOSITIONS THEREFOR

[75] Inventors: Hans E. Kubitschek; Louis Kravetz, both of Houston, Tex.

[73] Assignee: Shell Oil Company, Houston, Tex.

[21] Appl. No.: 656,457

[22] Filed: Feb. 9, 1976

[51] Int. Cl.[2] ..... C11D 7/54

[52] U.S. Cl. ..... 252/102; 252/95; 252/99; 252/186; 8/111; 423/272; 423/273

[58] Field of Search ..... 252/186, 99, 94, 102; 423/272, 273; 8/111

[56] References Cited

U.S. PATENT DOCUMENTS 3,378,444 4/1968 Swanson ..... 8/111

*Primary Examiner*—Mayer Weinblatt

[57] ABSTRACT

A process for the activation of peroxide-based bleaches comprises conjointly incorporating into an aqueous medium a peroxide-based bleach, sufficient buffering agent to maintain the aqueous medium under alkaline conditions and certain metal cyanamides (e.g., calcium cyanamide, disodium cyanamide and sodium acid cyanamide), which have been found to be highly effective peroxide activators when employed under alkaline conditions. Stable concentrated liquid and solid metal cyanamide-activated bleaching compositions are also disclosed.

25 Claims, No Drawings

ACTIVATED BLEACHING PROCESS AND COMPOSITIONS THEREFOR

BACKGROUND OF THE INVENTION

1. Field of the Invention

The present invention relates to an improved process for activating peroxide-based bleaches. In addition, it relates to concentrated bleaching compositions which alone or in combination with other ingredients, can be added to an aqueous medium to effect the bleaching of fibrous materials and other bleachable substances over a wide range of temperatures.

2. Description of the Prior Art

Peroxide-based bleaches, such as hydrogen peroxide and perborates, are well known in the art and have been used for a number of years for bleaching textiles, and more recently, in home laundering applications for the bleaching of fabrics which cannot be safely bleached with chlorine-based bleaches because of problems with fiber and color damage. However, for home laundering use such bleaching agents generally have the disadvantage, as compared to chlorine-based bleaches, that their bleaching effectiveness falls off rapidly as the temperature decreases. For example, peroxide-based bleaches are relatively ineffective at 60°–160° F, which are typical temperatures for home laundering in the United States.

Considerable effort has been devoted over the years to improve the effectiveness of peroxide-based bleaches at lower temperatures. One approach involves catalytic activation with the use of transition metals which decompose hydrogen peroxide to more reactive moieties which accelerate bleaching at lower temperatures. These activators generally must be used in the presence of compounds having suitable sequestering properties to prevent useless decomposition of the hydrogen peroxide. U.S. Pat. No. 2,975,139 to Kauffman et al. and U.S. Pat. No. 3,156,654 to Konecny et al are representative of this approach. However, despite its technical feasibility, catalytic activation has not found lasting commercial application because of the difficulty in controlling the activation phenomenon under practical conditions, and interference by other chemical substances commonly found in bleach/detergent compositions.

A different approach to activation involves the use of "organic activators" which react with hydrogen peroxide to form peracids, which are relatively strong bleaching agents. A great number of these so-called "organic activators" are described in the prior art and generally comprise compounds having one or more acyl groups. U.S. Pat. No. 2,898,181 to Dithmar et al, for example, discloses certain carboxylic acid amides as activators for perborate bleaching agents. U.S. Pat. No. 3,163,606 to Viveen et al discloses a variety of diacylated nitrogen containing compounds as activators for active oxygen releasing bleaches. Among the compounds specifically disclosed in this patent are N,N-diacetylcyanamide and the N-diacyldicyanodiamides. U.S. Pat. No. 3,583,924 to Demangeon et al. discloses a four component cleaning composition including a mineral persalt, an organic activator therefore, a water soluble cupric salt and a copper complexing agent. N,N-diacetylcyanamide and the N-diacyldicyanodiamides are also among the activators for the persalts specifically disclosed in this patent. A later issued Dithmar et al patent, U.S. Pat. No. 2,927,840, discloses that certain organic nitriles are likewise activators for peroxidic compounds. The patent teaches that the best results are obtained with organic nitriles containing a plurality of nitrile groups which are not separated too far from each other.

A further patent, U.S. Pat. No. 3,756,774 to Kirner, discloses that organic nitriles will react with hydrogen peroxide under acidic conditions to form stable peroxy carboximides which can be employed in the bleaching cellulosic textile materials in place of alkaline hydrogen peroxide solutions stabilized with sodium silicate. Among the various organic nitriles disclosed as being suitable for this purpose are cyanamide and dicyanodiamide.

Despite the extensive efforts devoted by those skilled in the art to finding suitable activators for peroxide-based bleaches, there is in the United States today little practical application of this technology.

There are a number of reasons for this. One is that organic activators generally must be used in equimolar proportions with the active oxygen releasing component of the bleach package. Since most organic activators are relatively expensive, this results in the activator contributing significantly to the cost of the bleach formulation, and in many cases makes the product prohibitively expensive relative to competitive hypochlorite bleaches. Also, may prior art organic activators are relatively toxic or have unpleasant odors which render them unsuitable for use in applications such as home laundering.

A further drawback of many known organic activators is that they are unstable in storage and, hence, are not suitable for use in commercial bleach products which are stored over extended periods of time in warehouses or on the supermarket shelf before consumer use.

The present invention provides a bleach activation process and related compositions based on an activator which not only provides substantially improved bleaching action at relatively low temperatures, but, in addition, is inexpensive and does not suffer from the drawbacks of many of the prior art organic activators, or at least to a substantially lesser degree.

SUMMARY OF THE INVENTION

It has now been found, and forms the basis of the present invention, that metal cyanamides when employed under alkaline conditions are extremely effective activators for peroxide-based bleaches over a wide range of temperatures, including low temperatures, such as those encountered in home laundering in the United States.

Thus, the present invention provides an improved peroxide-bleach activation process comprising conjointly incorporating into an aqueous medium effective amounts of (a) a peroxide-based bleach, (b) a peroxide-activating amount of metal cyanamide and (c) a buffering agent to maintain the aqueous medium under alkaline conditions. Since certain peroxide-based bleaches and metal cyanamides provide alkalinity upon dissolution in an aqueous medium, it is to be understood that the buffering agent (c) may be supplied in whole or in part by the peroxide-based bleach (a) or the metal cyanamide (b). The present invention also provides stable concentrated peroxide-based bleach compositions, which are preferably provided in solid (dry) form, but can also be provided in liquid form, and may be used for bleaching as such, or as a component of a soap or detergent formulation. Alternatively, the metal cyanamide activator and peroxide-based bleach may be added separately to an aqueous medium, together with sufficient buffering agent to maintain the pH of the aqueous bleaching/washing medium under alkaline conditions.

It has also been found that not only do metal cyanamides under alkaline conditions enhance the bleaching effectiveness of peroxide-based bleaches, but in addition metal cyanamide-activated peroxide-based bleaches appear to substantially improve the detergency of many conventional detergents, which makes the present compositions particularly attractive for use in laundry applications.

DETAILED DESCRIPTION OF THE INVENTION

Fundamental to this invention is the discovery that certain relatively inexpensive metal cyanamides when employed under alkaline conditions are surprisingly effective activators for peroxide-based bleaches. By "peroxide-based bleaches" as this term is used in this specification and claims, is meant hydrogen peroxide and any compound which releases hydrogen peroxide in aqueous solution. Such compounds include, for example, perborates, percarbonates, urea peroxides and ketone peroxides. Peroxy compounds of this type and their manner of preparation are well known in the art, and are described, for example, in Kirk-Othmer, Encyclopedia of Chemical Technology, 2nd ed. Vol. 14, pp. 757–760. Of the various peroxide-based bleaches which can be suitably employed in accordance with the invention, hydrogen peroxide, perborates and percarbonates are preferred. Particularly preferred among the perborates are the sodium perborates, especially sodium perborate tetrahydrate ($NaBO_3.4H_2O$) because of its commercial availability. However, sodium perborate trihydrate ($NaBO_3.3H_2O$) and sodium perborate monohydrate ($NaBO_3.H_2O$) can also be suitably employed.

Metal cyanamides which can be suitably employed in the activated bleach compositions of the invention include any metal cyanamide which is at least partially water soluble or water dispersible to provide reactive sites. Preferred metal cyanamides include Group IA and IIA metal salts of cyanamide, in particular calcium cyanamide (CaNCN), disodium cyanamide ($Na_2NCN$) and sodium acid cyanamide (NaHNCN). Dipotassium cyanamide ($K_2NCN$), potassium acid cyanamide (KHNCN), dilithium cyanamide ($Li_2NCN$), lithium acid cyanamide (LiHNCN), magnesium cyanamide (MgNCN), barium cyanamide (BaNCN) and strontium cyanamide (SrNCN) can also be employed. Disodium cyanamide and sodium acid cyanamide are especially preferred because of their availability and in cases where rapid solubility in an aqueous medium is desired.

The aforementioned metal cyanamides and their manner of preparation are known in the art, and are described for example in Kirk-Othmer, Encyclopedia of Chemical Technology, 2nd ed., Vol. 6, pp. 553–559. Calcium cyanamide can be employed in the present compositions in its crude form, which contains about 65 percent by weight (%w) calcium cyanamide, but preferably is employed in its purified form.

The mechanism by which metal cyanamides effect activation of peroxide-based bleaches is not precisely known. However, it has been found that in order to obtain enhanced bleaching activity it is necessary that the pH of the aqueous medium in which the bleaching or washing is accomplished (e.g., a washing machine in the case of home laundering) be maintained under alkaline conditions, e.g., at a pH of from 7.5 to about 13, or higher. Preferably the pH of the aqueous bleaching-/washing medium will be from about 8.0 to about 11.5.

As previously mentioned, an advantage of using metal cyanamide activators, as compared to cyanamide per se, is that hydroxyl groups are produced upon dissolution of many metal cyanamides in the aqueous bleaching/washing medium, thereby reducing or eliminating the need for the additional of alkaline buffering agents. If additional alkaline buffering agents are employed, they can be conveniently incorporated into dry bleach formulations or added to the aqueous bleaching-/washing medium. Suitable alkaline buffering agents of this type include carbonates, phosphates, silicates, citrates, polycarboxylates, borates and the like.

While metal cyanamide activators can most advantageously be utilized in concentrated dry peroxide-based bleach formulations in accordance with the invention, they can be employed in concentrated liquid bleach formulations as well. In this connection the metal cyanamide and peroxide bleach components can be suitably incorporated into a substantially non-aqueous liquid organic carrier material, or prepared as an aqueous solution, e.g., an aqueous hydrogen peroxide solution. However, in this latter case, the pH of the aqueous liquid formulation should be maintained at a relatively low pH (e.g., at a pH below about 5, preferably at a pH of from about 2 to 5) until the product is ready for use to prevent premature reaction and/or decomposition of the cyanamide and peroxide components. In this manner a stable (i.e., inactive or non-reactive bleach composition is provided, which can be readily activated upon use by adjusting the pH level to the alkaline conditions required for effective activation of the peroxide-based bleach. Such pH adjustment can be conveniently accomplished by the use of an alkaline buffering agent and/or detergent which commonly contain alkaline buffering agents.

Stable concentrated solid bleach compositions in accordance with the invention can be prepared from metal cyanamides and a solid peroxide-based bleach (e.g., sodium perborate or percarbonate) without the need for pH adjustment to below 5 level required for stable liquid bleach compositions. To ensure the stability of the solid-based bleach compositions, all that is required is that the compositions be maintained free from contaminating amounts of moisture. This can be conveniently accomplished by use of desiccants, if desired, and/or by encapsulating the metal cyanamide activator and/or the solid peroxide-based bleach as hereinafter discussed. To convert the stable solid bleach compositions of the present invention to their reactive state, all that is required is that they be added to the aqueous bleaching/washing medium. Since both metal cyanamides and solid peroxide-based bleaches, such as sodium perborate and percarbonate, are typically alkaline forming substances, the necessary alkaline conditions in the aqueous bleaching/washing medium can normally be obtained without further alkaline buffering agent addition. However, additional alkaline buffering agents can be (and usually are) employed if higher pH levels are desired.

From the foregoing it can be seen that the term "stable" as employed in connection with the concentrated solid and liquid bleach compositions in accordance with the invention, means the compositions are in an essentially inactive or non-reactive state (thereby facilitating their storage and handling), but can be readily converted to a reactive state at their time of use. In the case of concentrated liquid bleach compositions this is accomplished by pH adjustment from the below 5 level in storage, to an about 7.5 level in the aqueous bleaching-/washing medium, while in the case of concentrated solid bleach compositions all that will normally be required is that the metal cyanamide-activated peroxide-based bleach be added to an aqueous bleaching/washing medium.

An alternative method of practicing the present invention with regard to solid bleach compositions is to package the peroxide-based bleach and metal cyanamide in separate containers together with alkaline buffering agents as required to achieve the desired pH level, and add them to the aqueous bleaching/washing medium just prior to use, thereby forming the activated bleaching composition in situ.

As mentioned above, a useful technique for increasing the stability of the solid metal cyanamide-activated peroxide-based bleach compositions of the invention is by use of the well known technique of encapsulation. In general, any encapsulating technique which provides a covering for the metal cyanamide activator and/or peroxide-base bleach particles to prevent their coming into direct contact until they are added to the aqueous bleaching medium can be suitably employed in the practice of the present invention. Thus, the function of the covering material (encapsulating agent) is to prevent premature reaction or decomposition of the cyanamide activator and peroxide-based bleach while in storage, yet effectively release the activator and/or peroxide-based bleach upon addition to the aqueous bleaching medium.

Suitable encapsulating agents include both water soluble and water dispersible substances, such as stearic acid, polyethyleneglycols, condensation products of ethyleneoxide and propyleneoxide (e.g., alcohol ethoxylates), polyvinyl alcohol, carboxymethylcellulose, cetyl alcohol, fatty acid alkanolamides and the like. Encapsulation may be conveniently accomplished by dissolving the encapsulating agent in a volatile organic solvent and spraying the finely divided particles of cyanamide activator and/or peroxide activated bleach with the solution after which the sprayed particles are dried. Such a procedure is described, for example, in U.S. Pat. No. 3,163,606. Other suitable encapsulation techniques are described in U.K. Pat. No. 1,395,006.

A preferred concentrated peroxide-based bleach composition in accordance with the invention, especially from a storage stability standpoint, is a dry bleach formulation based on a combination of disodium cyanamide or sodium acid cyanamide with sodium perborate monohydrate as the peroxide-based bleach component. The advantage of utilizing the monohydrate form of sodium perborate is that any moisture absorbed by the dry bleach formulation during storage, will first act to convert the sodium perborate monohydrate to its higher hydrate forms (e.g., sodium perborate tetrahydrate), thereby making the package more stable to moisture contamination.

Disodium cyanamide also can serve to minimize the adverse affects of moisture on product stability, in that in the presence of moisture it merely converts to sodium acid cyanamide. By having to go through this intermediate step to make cyanamide, the use of disodium cyanamide increases the "shelf-life" of the total bleach.

Insofar as the proportions of the metal cyanamides to the peroxide-based bleach are concerned, all that is required for purposes of the present invention is that sufficient metal cyanamide be present in the composition to activate the peroxide-based bleach upon addition to an aqueous bleaching/washing medium under alkaline conditions. Generally, the molar ratio of metal cyanamide to the peroxide-based bleach will be on the order of from 1:20 to 20:1, with preferred ratios being from about 1:1 to about 1:10.

The amount of peroxide-based bleach employed in accordance with the invention will vary widely depending on the material to be bleached, the extent of bleaching desired, and the bleaching conditions. In general, the amounts of peroxide-based bleach, calculated as hydrogen peroxide, in the stable concentrated bleach compositions of the invention will range from about 1 to about 35%w, preferably from about 2 to about 15%w. Peroxide concentrations higher than 35%w, calculated as hydrogen peroxide, could be used, but generally would not, because of the reactivity of highly concentrated peroxide with organic material, which could form detonable mixtures. In cases where the peroxide-based bleach and metal cyanamide are incorporated into a conventional detergent composition, lower concentrations of peroxide-based bleach (e.g., from 0.1 to 2%w, calculated as hydrogen peroxide) can be employed. However, in this case generally lower levels of bleaching will be obtained than if the aforementioned concentrated metal cyanamide-activated peroxide-based bleach compositions were employed.

To effect bleaching, the activated peroxide-based bleach compositions of the invention are generally added to an aqueous medium in an amount that will result in 2 to 600 millimoles/liter (mmoles/l) of the peroxide-based bleach, calculated as hydrogen peroxide, being present in the aqueous medium. The precise peroxide-based bleach concentration selected will vary depending on the nature of the substance being bleached and the degree of bleaching desired.

For home and commercial laundry applications, the concentration of peroxide-based bleach in present compositions should suitably be such that the concentration of peroxide-based bleach, calculated as hydrogen peroxide, in the wash water will be about of 2 to 12 mmoles/l. As would be apparent to those skilled in the art, the foregoing concentrations could be varied if greater or lesser bleaching is desired.

The present compositions can be employed over a relatively wide range of temperatures, e.g., from about 45° F up to the boiling point of water (212° F). However, it can most advantageously be employed at temperatures of 60° to 160° F, which encompasses typical temperatures of home laundering in the United States. As previously stated, a substantial improvement in bleaching effectiveness is obtained by use of the present compositions as compared to the use of peroxide-based bleaches alone, or peroxide-based bleaches activated with many of the prior art activators.

The metal cyanamide-activated bleaching compositions of the present invention can be employed to bleach any of a wide variety of bleachable substances including textiles, wood and wood products, surfactants, leather, hair and any other substance commonly bleached with peroxide-based bleaches. The present metal cyanamide-activated peroxide-based bleach compositions are especially suitable for use in home and commercial laundering applications, in which unactivated peroxide-based bleaches are largely ineffectual because of the relatively short wash cycles and lower temperatures involved, particularly in the United States. The compositions of the invention are effective in bleaching stains from a wide variety of fabrics, including those manufactured from natural as well as synthetic fibers. They are particularly effective for washing cotton goods and goods produced from synthetic fibers, and are advantageous over chlorine-based bleaches in that they will not cause yellowing of fabrics even after repeated washings. In addition, the compositions of the present invention would be expected to cause considerably less loss in strength of fibers than do chlorine-based bleaches, and are also safer to use on colored materials. The present compositions can be safely employed in their concentrated or dilute forms, and may be used for presoaking as well as during washing.

In the case of home or commercial laundering, the compositions of the present invention will normally be employed in conjunction with a soap or detergent, which may be provided as a part of the bleach/washing composition, or may be added separately to the wash liquor. In general, any commonly used soap may be employed for this purpose, for example, alkali metal salts of fatty acids, such as stearic and/or palmitic acids, or of rosin acids. Synthetic detergents which can be used with or without such soaps include the anionic, cationic, zwitterionic, ampholytic, non-ionic and semipolar organic surface-active agents. Typical anionic detergents which can be employed in the practice of the present invention include various sulfates and sulfonates, such as alkyl aryl sulfonates, alkyl sulfonates, sulfates of fatty acid-monoglycerides, olefin sulfonates, sulfonated fatty acids and esters, alkyl glyceryl ether sulfonates, fatty isethionates, fatty acid oxyethylamide sulfates, oleylmethyltauride, and the like having aliphatic hydrocarbon chains of about 10 to about 20 carbon atoms, and alkyl sulfate, alkyl polyether sulfate and alkyl phenol polyether sulfate salts such as sodium lauryl sulfate, sodium alkyl phenol polyether sulfates and mixed secondary alkyl sulfate alkali metal salts of 8 to 18 carbon atoms per molecule. Examples of non-ionic surface active agents which can be used in the practice of the invention are the saponines, fatty alkanolamides, amine oxides and ethylene oxide condensation products with fatty acids, alcohols, polypropylene glycols, alkyl phenols, esters, and the like, especially those with alkyl chains of 8 to 20 carbon atoms and 3 to 20 glycol units per molecule. Examples of typically suitable cationic surface active agents include those based on diamines, e.g., N-aminoethyl stearyl amine and N-aminoethyl myristyl amine; amide-linked amines, e.g., N-aminoethyl-stearyl amide and N-aminoethyl-myristyl amide, quaternary ammonium compounds containing at least one long chain alkyl group attached to the nitrogen atom, e.g., ethyl-dimethyl-stearyl ammonium chloride and dimethyl-propyl-myristyl ammonium chloride; and the like.

Any of the builders or other additives conventionally employed in bleach or detergent products can be used in the bleaching compositions of the invention. These include, for example, alkaline materials such as alkali metal hydroxides, phosphates (including orthophosphates, tripolyphosphates and pyrophosphates), carbonates, bicarbonates, citrates, polycarboxylates, borates and silicates, also alkanolamines and ammonia. Inert compounds such as alkali metal sulfates or chlorides can also be employed.

It has been found that the presence of sodium tripolyphosphate (STPP) and trisodium phosphate (TSP) in the aqueous bleaching/washing medium further enhances the bleaching action of the metal cyanamide-activated peroxide-based bleach. Hence, in a preferred embodiment of the present invention, STPP or TSP (or a detergent containing either of these compounds) is added to the aqueous bleaching/washing medium in addition to the peroxide-based bleach and metal cyanamide activator.

Other additives which may optionally be incorporated in or used in conjunction with the instant compositions include fabric softeners, germicides, fungicides, enzymes, anti-redeposition agents, flocculents, optical brighteners, colorants, perfumes, thickeners, stabilizers, suds-builders or suds-depressants, anti-corrosion agents, fluorescent agents and the like.

The activated bleaching compositions of the invention may generally also be used for their germicidal properties in various applications, for example, as a disinfectant for use in the home, e.g., in kitchens, bathrooms, etc., for institutional use, for water treatment and the treatment of swimming pools, etc.

The present invention and its benefits are further described in the following examples, which are intended only to be illustrative of the invention, and should not be construed as limiting.

EXAMPLE 1

The following experiments evidence the improved bleaching action obtainable by practice of the present invention. The general procedure employed in these tests were as follows:

Five hundred (500) ml of deionized water was added to a U.S. Testing, Inc. Terg-O-Tometer bath maintained at a temperature of 120° F and the hardness level of the water adjusted to 150 ppm as $CaCO_3$ (Ca/Mg = 3/2 on a molar basis). The peroxide-based bleach (sodium perborate tetrahydrate) and metal cyanamide activator (crude calcium cyanamide) were then added to the wash water in the concentrations shown in Table I, and the water agitated to avoid localized concentrations of any one additive. The pH of the water in the bath was maintained in the general range of 10–11.5 throughout the test. Although sodium perborate and calcium cyanamide give alkaline solutions, a detergent was used to simulate home laundry conditions. In this example Tide containing 12.3 percent phosphorus (Tide, 12.3%P) was employed as the detergent. Finally, four swatches, measuring 4 × 4, of EMPA 115 cloth (a standard cotton bleach test cloth soiled with sulfur black dye) were introduced into the wash water and the agitator run for 10 minutes at 100 rpm. At the conclusion of the wash cycle, the swatches were removed and rinsed by squeezing under a tap. The test cloths were then dried and the reflectance values measured on a Gardner Reflectometer, Model UX-2, utilizing a G (green) filter. The change that occurred as a result of the bleach/wash cycle was reported as the change in percent reflectance value (ΔR), which equals the difference between the reflectance of the swatch after bleaching and the reflectance of the same swatch before bleaching. Thus the larger the ΔR value, the more effective the bleaching action.

The compositions tested and the results obtained are presented in the following table:

TABLE I

| Experiment No. | Bleach (SPB-4)[a] mmoles/1 | CaNCN[b] mmoles/1 | Detergent,[c] g/1 | pH (final) | Temp. ° F | ΔR |
|---|---|---|---|---|---|---|
| 1 | 8 | — | 1.5 | 10.2 | 120 | 2.0 |
| 2 | 8 | 8 | 1.5 | 11.2 | 120 | 21.0 |
| 3 | 8 | 4 | 1.5 | 10.7 | 120 | 9.1 |
| 4 | 16 | 16 | 1.5 | 11.3 | 120 | 25.8 |
| 5 | 16 | 8 | 1.5 | 10.9 | 120 | 27.0 |
| 6 | 24 | 24 | 1.5 | 11.3 | 120 | 31.3 |
| 7 | 24 | 12 | 1.5 | 10.9 | 120 | 34.9 |
| 8 | 8 | 16 | 1.5 | 11.3 | 120 | 16.1 |
| 9 | 24 | 8 | 1.5 | 10.7 | 120 | 21.1 |

[a]SPB-4 = sodium perborate tetrahydrate.
[b]Introduced as crude CaNCN (typical assay approximately 65% CaNCN).
[c]Tide, 12.3%P (Tide is a powdered detergent manufactured by Procter & Gamble Company).

The foregoing test results indicate that the bleaching action of sodium perborate tetrahydrate is substantially enhanced when activated with various proportions of crude calcium cyanamide.

EXAMPLE 2

In this example a series of experiments was conducted employing the preferred purified form of calcium cyanamide instead of the crude form employed in Example 1. Except as noted, essentially the same test procedure was employed as in Example 1. The compositions tested and test results are reproduced below.

TABLE II

| Experiment No. | Bleach (SPB-4)[a] mmoles/1 | CaNCN[b] mmoles/1 | Detergent[c] g/1 | pH Initial | pH Final | Temp ° F | ΔR Wash Cycle 10mins | 20mins | 30mins | 60mins |
|---|---|---|---|---|---|---|---|---|---|---|
| 10 | 8 | 0 | 1.5 | 9.4 | 9.3 | 185 | 8.1 | 11.4 | 14.2 | — |
| 11 | 8 | 8 | 1.5 | 9.7 | 10.0 | 185 | 33.0 | 38.9 | 41.6 | — |
| 12 | 8 | 0 | 1.5 | 10.3 | 10.2 | 120 | 1.9 | 2.8 | 3.8 | — |
| 13 | 8 | 8 | 1.5 | 10.7 | 11.4 | 120 | 11.9 | 24.3 | 33.4 | — |
| 14 | 8 | 8[d] | 1.5 | 11.3 | 11.2 | 120 | 23.8 | 31.0 | 33.3 | — |
| 15 | 8 | 0.8[d] | 1.5 | 10.4 | 10.3 | 120 | 5.8 | 7.9 | 9.7 | — |
| 16 | 8 | 0 | 1.5 | 9.9 | 9.7 | 45 | — | — | 0.5 | 1.1 |
| 17 | 8 | 8 | 1.5 | 10.9 | 11.0 | 45 | — | — | 2.8 | 8.5 |

[a]SPB-4 = sodium perborate tetrahydrate.
[b]Introduced as pharmaceutical grade CaNCN (typical assay approximately 96% CaNCN)
[c]Tide, 6.1%P.
[d]CaNCN activator dissolved in hot water prior to additon to Terg-O-Tometer.

From the foregoing results it is apparent that CaNCN effectively activates sodium perborate over a wide range of temperatures, with the very substantial bleach enhancement benefits being achieved at a temperature of 120° F, which is representative of home laundering conditions in the United States.

EXAMPLE 3

In this example a series of experiments was conducted to demonstrate the effectiveness of sodium acid cyanamide as a peroxide-based bleach activator. The peroxide-based bleach employed in these tests was either sodium perborate monohydrate or sodium perborate tetrahydrate. The test procedure employed was essentially the same as in Example 2 except as indicated.

The compositions tested and results obtained are summarized in the following table.

TABLE III

| Experiment No. | Bleach mmoles/1 | NaHNCN mmoles/1 | Detergent[a] Type | Detergent[a] g/1 | pH Initial | Temp. ° F. | ΔR Wash Cycle 10 mins. | 20 mins. | 30 mins. | 60 mins. |
|---|---|---|---|---|---|---|---|---|---|---|
| 18 | 8[b] | — | — | — | 10.5 | 118 | 2.4 | 3.4 | 3.8 | — |
| 19 | 8[b] | 8 | — | — | 10.7 | 118 | 26.2 | 28.8 | 31.9 | 33.6 |
| 20 | 8[b] | 8 | A | 1.5 | 10.4 | 118 | 28.2 | 34.6 | 38.0 | 42.2 |
| 21 | 8[b] | 8 | B | 1.5 | 10.8 | 118 | 13.1 | 15.3 | 17.2 | 19.2 |
| 22 | 8[c] | 0.8 | B | 1.5 | 10.1 | 118 | 6.8 | 8.9 | 10.7 | — |
| 23 | 8[c] | 80 | B | 1.5 | 10.9 | 118 | 6.2 | 7.2 | 8.3 | — |

[a]Detergent A - Cheer, 0%P (Cheer is a powdered detergent manufactured by Proctor & Gamble Company).
Detergent B - Tide, 6.1%P.
[b]Sodium perborate monohydrate.
[c]Sodium perborate tetrahydrate.

From the above data it can be seen that sodium acid cyanamide materially enhances the bleaching activity of sodium perborate bleach in the presence or absence of detergents.

EXAMPLE 4

In this example a solid bleaching composition in accordance with the invention was subjected to a high temperature storage stability test. In this test the composition was placed in a loosely capped bottle in an oven at 50° C and the bleaching effectiveness of the composition (ΔR) determined at the outset of the test, after 10 days storage and after encapsulation and an additional 27 days storage. The composition tested and the results obtained were as follows:

COMPOSITION 5.9%w Sodium acid cyanamide
18.6%w Sodium perborate monohydrate
10.6%w Magnesium sulfate, anhydrous
64.9%w Sodium carbonate, anhydrous

| Stability at 50° C | | | | |
|---|---|---|---|---|
| Days in | | | ΔR[a] Wash Cycle | |
| Storage | 10 mins | 20 mins | 30 mins | 60 mins |
| 0 | 29 | 38 | 41 | 44 |
| 10[b] | 28 | 36 | 40 | 43 |
| 37 | 26 | 34 | 36 | 39k |

[a]Determined under essentially the same conditions as in Exaple 1, except that 1.5 g/l of Cheer, 0%P, was employed as the detergent.
[b]After 10 days the composition was removed from the oven and encapsulated with 12 parts of Neodol® 25-9 (a $C_{12}$—$C_{15}$ linear, primary alcohol ethoxylate) per hundred parts of the composition. Encapsulation was effected by blending the composition with the encapsulating agent with mechanical agitation. After encapsulation, the composition was returned to the over and the test continued.

The foregoing results indicate the encapsulated test composition retained approximately 90% of its bleaching effectiveness after 37 days storage at 50° C.

It is understood that the foregoing detailed description of the invention is merely given by way of illustration, and that many variations may be made therein without departing from the spirit and scope of the invention.

What is claimed is:

1. A process for activating a peroxide-based bleach which comprises conjointly incorporating into an aqueous medium effective amounts of (a) a peroxide-based bleach, (b) a peroxide-activating amount of a Group IA or IIA metal cyanamide and (c) a buffering agent to maintain the aqueous medium under alkaline conditions.

2. The process of claim 1 wherein the temperature of the aqueous medium is from 60° to about 160° F.

3. The process of claim 1 wherein the amount of buffering agent is sufficient to maintain the pH of the aqueous medium within the range 7.5 to about 13.

4. The process of claim 1 wherein the peroxide-based bleach is sodium perborate or sodium percarbonate.

5. The process of claim 4 wherein the peroxide-based bleach or metal cyanamide activator also serves as the buffering agent.

6. The process of claim 5 wherein the metal cyanamide activator is calcium cyanamide, disodium cyanamide or sodium acid cyanamide.

7. The process of claim 6 wherein the peroxide-based bleach is sodium perborate monohydrate and the metal cyanamide activator is sodium acid cyanamide.

8. The process of claim 7 wherein the amount of buffering agent is sufficient to maintain the pH of the aqueous medium within the range of about 8.0 to about 11.5.

9. A stable concentrated bleaching composition consisting essentially of a peroxide-based bleach and a peroxide-activating amount of a Group IA or IIA metal cyanamide as an activator therefore.

10. The bleaching composition of claim 9 wherein the amount of peroxide-based bleach in the bleaching composition is from about 1 to about 35% by weight, calculated as hydrogen peroxide, of the total composition.

11. The bleaching composition of claim 10 wherein the molar ratio of metal cyanamide to peroxide-based bleach is 1:20 to 20:1.

12. The bleaching composition of claim 11 wherein the metal cyanamide activator is calcium cyanamide, disodium cyanamide or sodium acid cyanamide.

13. The bleaching composition of claim 12 wherein the molar ratio of activator to peroxide-based bleach is 1:1 to 1:10.

14. The bleaching composition of claim 11 wherein the peroxide-based bleach is sodium percarbonate.

15. The bleaching composition of claim 11 wherein the peroxide-based bleach is sodium percarbonate.

16. The bleaching composition of claim 15 wherein the metal cyanamide activator is sodium acid cyanamide.

17. The bleaching composition of claim 16 wherein the sodium perborate is sodium perborate monohydrate.

18. The bleaching composition of claim 15 which additionally contains a detergent.

19. The bleaching composition of claim 18 wherein the peroxide-based bleach or metal cyanamide activator is encapsulated.

20. A bleaching/washing composition consisting essentially of an aqueous medium containing from about 2 to about 600 millimoles/liter of a peroxide-based bleach, calculated as hydrogen peroxide, a peroxide-activating amount of a Group IA or IIA metal cyanamide, a buffering agent to maintain the pH of the aqueous medium within the range of 7.5 to about 13 and a bleachable substance.

21. The composition of claim 20 additionally containing a detergent.

22. The composition of claim 21 wherein the aqueous medium contains from about 2 to about 12 millimoles/liter of peroxide-based bleach, calculated as hydrogen peroxide and sufficient buffering agent to maintain the pH of the aqueous medium within the range of about 8.0 to about 11.5.

23. The composition of claim 22 wherein the bleachable substance is a fabric.

24. In a process for manufacturing a built laundry detergent composition comprising a synthetic detergent and an alkaline detergent builder, the improvement which comprises incorporating into said detergent composition from 0.1 to 2% by weight, calculated as hydrogen peroxide, of a peroxide-based bleach and a peroxide-activating amount of a Group IA or IIA metal cyanamide.

25. A laundry detergent composition consisting essentially of (1) a major amount of a synthetic detergent and an alkaline detergent builder, (2) a minor amount, from 0.1 to 2% by weight, calculated as hydrogen peroxide, of a peroxide-based bleach and (3) a peroxide activating amount of a Group IA or IIA metal cyanamide.

* * * * *